US006135739A

United States Patent [19]

Ogawa et al.

[11] Patent Number: 6,135,739

[45] Date of Patent: Oct. 24, 2000

[54] SCROLL COMPRESSOR

[75] Inventors: Hiroshi Ogawa; Minoru Ishii; Kiyoharu Ikeda; Yasuhiro Suzuki; Takeshi Fushiki; Takashi Sebata; Susumu Kawaguchi; Yoshihide Ogawa, all of Tokyo; Wataru Izumisawa, Yokosuka, all of Japan

[73] Assignee: Mitsubishi Denki Kabushiki Kaisha, Tokyo, Japan

[21] Appl. No.: 09/270,680

[22] Filed: Mar. 16, 1999

[30] Foreign Application Priority Data

Oct. 1, 1997 [JP] Japan ..... 9-268579
Nov. 20, 1998 [JP] Japan ..... 10-330775

[51] Int. Cl.[7] ..... F04C 18/00

[52] U.S. Cl. ..... 418/55.5; 418/57; 418/55.6; 418/14; 418/55

[58] Field of Search ..... 418/55.5, 57, 55.6, 418/55, 14

[56] References Cited

U.S. PATENT DOCUMENTS

| | | | |
|---|---|---|---|
| 4,596,521 | 6/1986 | Murayama et al. | 418/55 |
| 4,623,306 | 11/1986 | Nakamura et al. | 418/55 |
| 4,838,773 | 6/1989 | Noboru | 418/55 |
| 5,192,202 | 3/1993 | Lee | 418/55.5 |
| 5,487,653 | 1/1996 | Lee | 418/14 |
| 5,540,572 | 7/1996 | Park et al. | 418/55.5 |

FOREIGN PATENT DOCUMENTS

| | | | |
|---|---|---|---|
| 0 322 894 | 7/1989 | European Pat. Off. . | |
| 0 878 626 | 11/1998 | European Pat. Off. . | |
| 2 559 847 | 8/1985 | France . | |
| 0074591 | 3/1991 | Japan | 418/55.5 |
| 403067080 | 3/1991 | Japan | 418/55.6 |
| 404203381 | 3/1991 | Japan | 418/55.6 |
| 3-175184 | 7/1991 | Japan . | |
| WO95/12759 | 5/1995 | WIPO . | |

*Primary Examiner*—Thomas Denion
*Assistant Examiner*—Thai-Ba Trieu
*Attorney, Agent, or Firm*—Oblon, Spivak, McClelland, Maier & Neustadt, P.C.

[57] ABSTRACT

A scroll compressor comprising a fixed scroll, a rotating scroll, a compliant frame for supporting the rotating scroll in an axial direction and a main shaft for driving the rotating scroll in directions of radiuses of the rotating scroll, and a guide frame fixed to a hermetically sealed vessel for supporting the compliant frame in the directions of its radiuses, wherein the rotating scroll is slidable in the axial direction by sliding of the compliant frame on the guide frame; a space is formed between the compliant frame and the guide frame; and a pressure in the space is made to be a pressure higher than a suction pressure and the same as a discharge pressure or less, whereby relief of the rotating scroll is avoidable to quickly and constantly realize a state of normal operation.

20 Claims, 7 Drawing Sheets

SCROLL COMPRESSOR

BACKGROUND OF THE INVENTION

1. Field of the Invention

The present invention relates to a refrigerant compressor used for a refrigerating machine.

2. Discussion of Background

FIG. 8 is a cross-sectional view in a longitudinal direction of a scroll compressor shown in Japanese Patent Application JP9-268579 as a background art. Numerical reference 1 designates a fixed scroll, of which outer periphery is fastened by bolts (not shown) to a guide frame 15. A spiral turbine 1*b* is formed in one surface (a lower side in FIG. 8) of a seat 1*a*, and a pair of a Oldham's coupling grooves are formed to be substantially linear in an outer periphery of the seat, with which Oldham's coupling groove 1*c* a pair of fixed projections 9*c* of an Oldham's coupling 9 are engaged so as to be reciprocally slidable. A suction tube 10*a* is press-fitted to a hermetically sealed vessel by penetrating from a side of the fixed scroll 1 (a right side in FIG. 8).

Numerical reference 2 designates a rotating scroll, on one surface of a seat 2*a* (an upper side in FIG. 8) of which a spiral turbine 2*b* having substantially the same shape as that of the spiral turbine 1*b* of the fixed scroll 1 is formed. On a central portion of an opposite surface (a lower side in FIG. 8) to that of the spiral turbine 2*b* of the seal 2*a*, a boss 2*f* having a hollow cylindrical shape is formed, and on an inner side surface of the boss 2*f*, a bearing 2*c* is formed. Further, on an outer periphery in the same surface as that of the boss 2*f*, a thrust face 2*d* which is slidably in contact with a thrust bearing 3*a* of a compliant frame 3 is formed. In an outer periphery of the seal 2*a* of the rotating scroll 2, a pair of Oldham's coupling groove 2*e* are formed to be substantially linear, which has a phase difference of about 90° from the Oldham's coupling groove 1*c* of the fixed scroll, to which Oldham's coupling groove 2*e* a pair of rotating projections 9*a* of the Oldham's coupling 9 are engaged reciprocally slidable.

In a central portion of the compliant frame 3, a main bearing 3*c* and an auxiliary main bearing 3*h*, both for holding a main shaft 4 rotatably driven by a motor in the direction of its radius are formed. Although an outer periphery 15*g* of the guide frame 15 is fixed to the hermetically sealed vessel by an interference shrink fit, a welding or the like, a flow path for introducing a refrigerant gas having a high pressure discharged from a discharge port 1*f* of the fixed scroll 1 from the guide frame 15 to a discharge tube 10*b* provided on the side of motor (lower side in FIG. 8) is maintained. An upper bore surface 15*a* is formed on the side of fixed scroll in an inner side surface of the guide frame 15 (upper side in FIG. 8) and fitted and engaged with an upper cylindrical surface 3*d* formed in an outer periphery surface of the compliant frame 3. On the other hand, a lower bore surface 15*b* is formed on the side of motor in an inner side surface of the guide frame 15 (lower side in FIG. 8) and fitted and engaged with a lower cylindrical surface 3*e* formed in an outer peripheral surface of the compliant frame 3. In an inner side surface of the guide frame 15, two sealing grooves for accommodating a sealing material are formed, and an upper seal 16*a* and a lower seal 16*b* are fitted and engaged with these sealing grooves. A space 15*f* formed among these two seals, the inner side surface of the guide frame 15 and the outer side surface of the compliant frame 3 is connected to a space around the boss 2*h* through a pressure equalizing aperture 3*i* formed in the compliant frame 3. The upper seal 16*a* and the lower seal 16*b* are not necessarily indispensable and can be omitted if sealing is possible in a micro-clearance among engaging portions. A space around the outer periphery of the seat 2*i*, which is in the outer peripheral side of the thrust bearing 3*a* surrounded by the seat 2*a* of the rotating scroll and the compliant frame 3 in the vertical directions, is connected to a suction chamber 1*g* in the vicinity of an end of the spiral turbine to have an atmosphere of suction gas.

In an end of the main shaft 4 on the side of rotating scroll (upper side in FIG. 8), an orbit shaft body 4*b* which is rotatably engaged with the bearing 2 of the rotating scroll 2 is formed. To the lower side of the main shaft, a main shaft balancer 4*e* is fixed by an interference shrinkage fit, and a main shaft body 4*c* which is rotatably engaged with the main bearing 3*c* and the auxiliary main bearing 3*h* both of the compliant frame 3 is formed beneath the main shaft balancer. On the other end of the main shaft, a subshaft body 4*d* rotatably engaged with a subbearing 6*a* of a subframe 6 is formed. Between the subshaft body 4*d* and the above-mentioned main shaft body 4*c*, a rotor of motor 8 is fixed by an interference shrinkage fit. An upper balancer 8*a* is formed on an upper end of the rotor 8, and a lower balancer 8*b* is fastened to a lower end of the rotor, whereby a static balance and a dynamic balance are maintained by the above-mentioned main shaft balancer 4*e* and these three balancers. An oil pipe 4*f* is press-fitted to a lower end of the main shaft 4 for sucking up a refrigerating oil 10*e* accumulated in a bottom of the hermetically sealed vessel 10. A glass terminal 10*f* is attached to a side surface of the hermetically sealed vessel 10, to which glass terminal a lead wire from a stator of motor is connected.

Standard operation of the conventional scroll compressor will be described. In normal operation, because an area of the hermetically sealed vessel 10*d* has a high pressure under an atmosphere of discharge gas, the refrigerating oil 10*e* in the bottom of the hermetically sealed vessel 10 is introduced from a high-pressure lubrication hole 4*g* formed in the main shaft 4 by penetrating in the axial direction to a space in the boss 2*g*. This high-pressure oil is depressurized by the bearing 2*c* so as to have an intermediate pressure and flows toward the space around the boss 2*h*. The refrigerating oil having an intermediate pressure flows through the pressure equalizing aperture 3*i* to the space 15*f* and is released to the space around the outer periphery of the seat 2*i* having a low pressure through an intermediate pressure adjusting valve or the like. Although downward force as much as the sum of force caused by the intermediate pressure in the space around boss 2*h* and a pressure from the rotating scroll 2 through the thrust bearing 3*a* effects on the compliant frame 3, upward force as much as the sum of force caused by the intermediate pressure in the space 15*f* and a force caused by the high pressure effecting on a portion exposed to the atmosphere of high pressure in the lower end surface produces force larger than the downward force in the normal operation. Accordingly, in the compliant frame 3, the upper cylindrical surface 3*d* is guided by the upper bore surface 15*a* of the guide frame and the lower cylindrical surface 3*e* is guided by the lower bore surface 15*b* of the guide frame 15, whereby the compliant frame 3 floats on the side of the fixed scroll in the upward direction in FIG. 8. Also the rotating scroll 2 pushed to the compliant frame 3 through the trust bearing 3*a* floats in the upward direction, wherein tops and bottom of the rotating scroll 2 are slidably in contact with bottom and tops of the fixed scroll 1 respectively.

At a time of starting up and liquid compression, a load by gas in the thrust direction effecting on the rotating scroll 2 is increased to strongly push down the compliant frame 3 on the reverse side of the fixed scroll through the rotating scroll 2 and the thrust bearing 3*a*. Therefore, a relatively large gap is produced between the tops and the bottom of the rotating scroll 2 and the bottom and the tops of the fixed scroll 1 so as to be able to avoid an abnormal pressure increase in a compression chamber. The amount of relief is determined by a distance between a contact face 3*q* of the compliant frame 3 and a contact face 15*h* of the guide frame 15. Incidentally, although a part of or all of overturning moment generated in the rotating scroll 2 is transmitted through the thrust bearing 3*a*, resultant force of a load received from the main shaft bearing 3*c* and a reaction to the load, namely coupled force of reaction force received from the guide frame 15 through the upper cylindrical surface 3*d* and reaction force received from the guide frame 15 through the lower cylindrical surface 3*e*, acts to compensate the overturning moment, whereby excellent stability in follow-up operation and also in relief operation is obtainable.

In the conventional scroll compressor of which compliant frame was movable in the axial direction by maintaining its own balance in terms of the moment, i.e. so-called compliant frame type scroll compressor of the background art, the intermediate pressure in the space around boss 2*h* leaked to the space around outer periphery of seat 2*i* when the rotating scroll 2 flapped on the thrust bearing 3*a* of the compliant frame 3 by a tiny outer disturbance such as a variation of a condition of operating pressure and suction of liquid refrigerant. Consequently, the intermediate pressure in the space 15*f* leaked to the space around outer periphery of seat 2*i* having an atmosphere of low pressure through the pressure equalizing aperture 3*i*. Accordingly, force for lifting the compliant frame 3 up on the side of the fixed scroll (upward direction in FIG. 8) was decreased to thereby relieve the compliant frame 3 on the reverse side of the fixed scroll (downward direction in FIG. 8) along with the rotating scroll 2. In other words, there was unstability that the rotating scroll 2 was easily relieved by a tiny outer disturbance.

Further, in the conventional scroll compressor, a degree of freedom in setting a working area of the space 15*f*, i.e. an area having the intermediate pressure, which was a major factor of lifting up the compliant frame 3 on the side of the fixed scroll (upward direction in FIG. 8), was less because it should have be restricted by a working area of the space around boss 2*h*, i.e. the same space having the intermediate pressure as that of the space.

Further, in the conventional scroll compressor, the intermediate pressure in the space 15*f*, which was a major factor of lifting the compliant frame 3 up on the direction of fixed scroll (upward direction in FIG. 8) just after starting up, was generated such that an inner pressure of the hermetically sealed vessel 10 was increased and the refrigerating oil 10*e* having a high pressure was choked by the bearing and flows into the space 15*f*. Therefore, there was a time lag until the intermediate pressure in the space 15*f* starts to rise. Accordingly, there was a problem that it took a time until the compliant frame 3 floated for the normal operation, in other words, a considerable amount of time was necessary for starting up.

Further, in the conventional scroll compressor, there were problems that the spiral turbines 1*b* and 2*b* may have been destroyed and that the bearing 2*c* and the main bearing 3*c* are seized by an excessive load as a result of an abnormal pressure rise in the compression chamber, formed by the spiral turbine 1*b* of the fixed scroll 1 and the spiral turbine 2*b* of the rotating scroll 2, caused by a liquid compression when an amount of play in the axial direction of the compliant frame 3 was small enough to allow a liquid refrigerant to suck in a running state.

Further, in the conventional scroll compressor, there were problems that an extremely long period was necessary to realize normal operation by making the compliant frame 3 float or that starting-up was impossible at worst because, when the amount of play in the axial direction of the compliant frame 3 was large, the compliant frame 3 was maximally relieved at the time of starting up so that the rotating scroll 2 was apart from the fixed scroll 1 to the maximum extent in the axial direction; the rotating scroll 2 arbitrarily rotates with effecting less compressing operation; and therefore the inner pressure of the hermetically sealed vessel is scarcely increased.

SUMMARY OF THE INVENTION

It is an object of the present invention to solve the above-mentioned problems inherent in the conventional technique and to improve unstability that the compliant frame 3 and the rotating scroll 2 are easily relieved by flapping of the rotating scroll 2 caused by a tiny outer disturbance.

Another object of the present invention is to provide a sufficient degree of freedom for setting a working area of the space 15*f*.

Another object of the present invention is to provide a compressor having an excellent starting-up property.

Another object of the present invention is to provide a compressor having no possibility of destroying spiral turbines for compression and bearings are not seized.

Another object of the present invention is to provide a compressor having an excellent starting-up property.

Another object of the present invention is to provide a compressor in which a loss by sliding of a rotating scroll is reduced and stable lubrication to bearings is possible.

According to a first aspect of the present invention, there is provided a scroll compressor comprising a fixed scroll having a spiral turbine and a rotating scroll having a spiral turbine, which spiral turbines are engaged each other to form a compression chamber between these, which fixed scroll and rotating scroll are located in a hermetically sealed vessel, a compliant frame for supporting the rotating scroll in its axial direction and supporting a main shaft for driving the rotating scroll in directions of its radiuses, and a guide frame for supporting the compliant frame in the directions of the radiuses, which guide frame is fixed to the hermetically sealed vessel, in which the rotating scroll is movable in the axial direction by a sliding motion of the compliant frame with respect to the guide frame in the axial direction, wherein a space is formed between the compliant frame and the guide frame; and a pressure in the space is higher than a suction pressure and is the same as a discharge pressure or less.

According to a second aspect of the present invention, there is provided a scroll compressor according to the first aspect of the invention, wherein a space around boss having a pressure higher than the suction pressure and the same as the discharge pressure or less is formed between the rotating scroll and the compliant frame.

According to a third aspect of the present invention, there is provided a scroll compressor according to the second aspect of the invention, wherein the space around boss and the space are connected; and a fluid is allowed to flow from the space around boss to the space.

According to a fourth aspect of the present invention, there is provided a scroll compressor according to the third aspect of the invention, wherein a bottom portion of the hermetically sealed vessel accumulating a refrigerating oil has a high pressure of which magnitude is around that of the discharge pressure; the space around boss is located in a middle of an oil supplying route and the space is connected to an area having a low pressure through a pressure adjusting device.

According to a fifth aspect of the present invention, there is provided a scroll compressor according to the second aspect of the invention, wherein a pressure in the space and a pressure in the space around boss are independent each other.

According to a sixth aspect of the present invention, there is provided a scroll compressor according to the second aspect of the invention, wherein a bottom portion of the hermetically sealed vessel accumulating a refrigerating oil has a high pressure of which magnitude is around that of the discharge pressure; the space around boss is located in a middle of an oil supplying route and the space around boss is connected to an area having a low pressure through a pressure adjusting device.

According to a seventh aspect of the present invention, there is provided a scroll compressor according to any one of the first, the second, the fifth, and the sixth aspects of the invention, wherein the space is connected to the compression chamber under compressing operation to make a pressure in the space higher than the suction pressure and the same as the discharge pressure or less.

According to an eighth aspect of the present invention, there is provided a scroll compressor comprising a fixed scroll having a spiral turbine and a rotating scroll having a spiral turbine, which spiral turbines are engaged each other to form a compression chamber between these, which fixed scroll and rotating scroll are located in a hermetically sealed vessel, a compliant frame for supporting the rotating scroll in its axial direction and supporting a main shaft for driving the rotating scroll in directions of its radiuses, and a guide frame for supporting the compliant frame in the directions of radiuses which guide frame is fixed to the hermetically sealed vessel, in which the rotating scroll is movable in the axial direction by a sliding motion of the compliant frame with respect to the guide frame in the axial direction, wherein a space is formed between the compliant frame and the guide frame; a pressure in the space is higher than a suction pressure and the same as a discharge pressure or less; and the maximum movable distance of the rotating scroll with respect to the guide frame in the axial direction is 30 $\mu$m or more and 300 $\mu$m or less.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

A detailed explanation will be given of preferred embodiments of the present invention in reference to FIGS. 1 through 8 as follows, wherein the same numerical references are used for the same or the similar portions and description of these portions is omitted.

Embodiment 1

Figure 1:
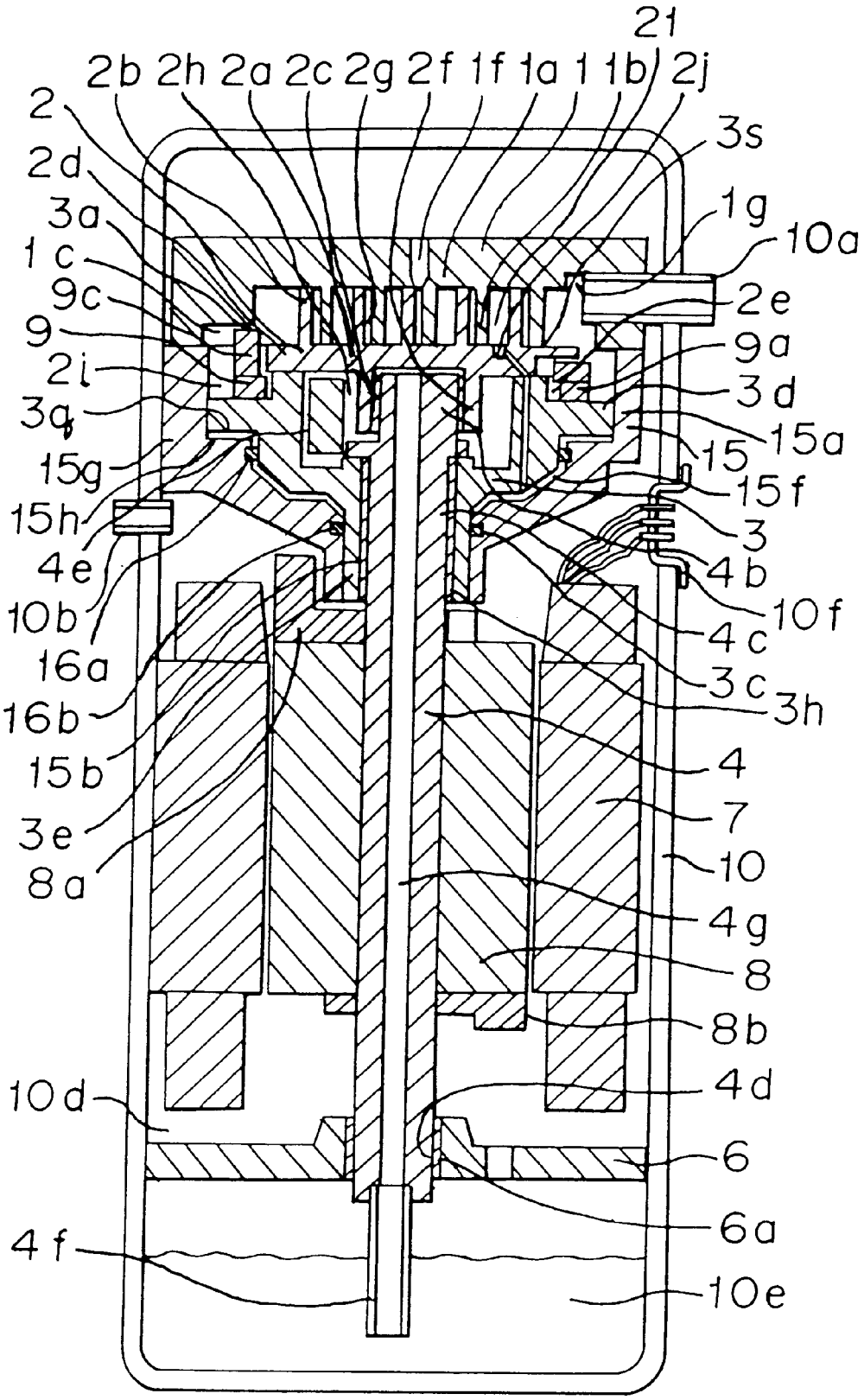
FIG. 1 is a longitudinal cross-sectional view according to Embodiment 1 of the present invention.
Figure 2:
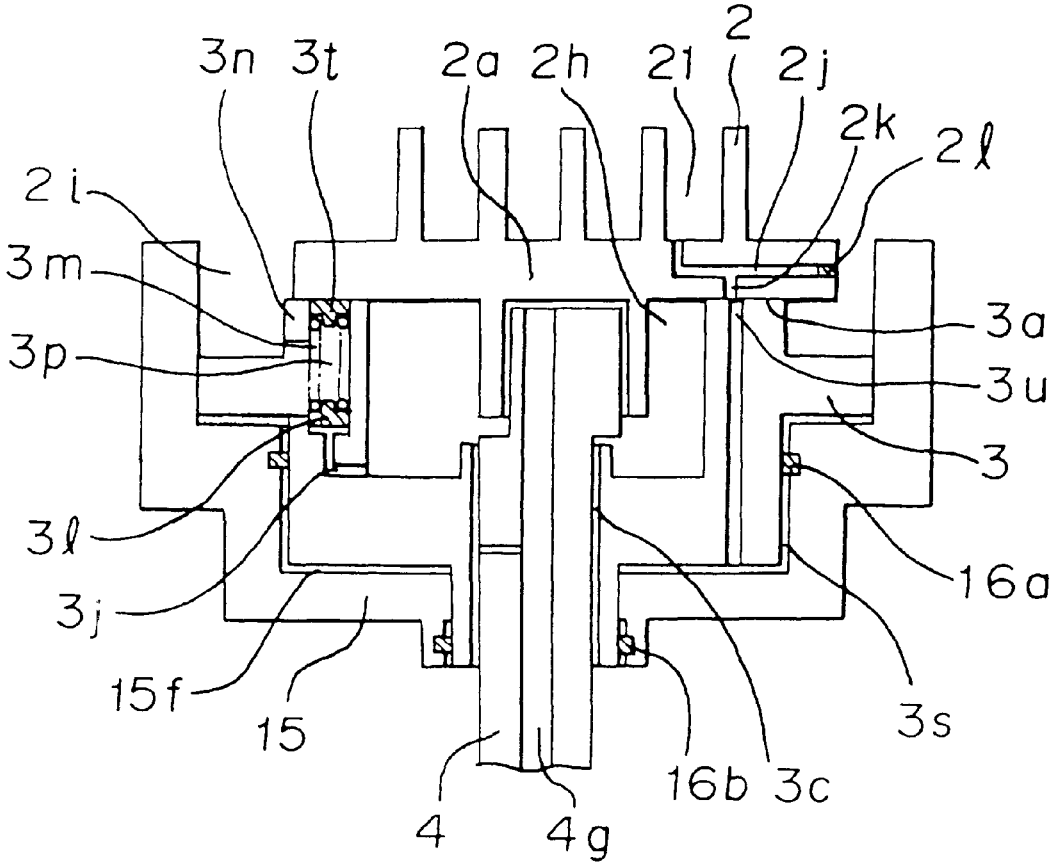
FIG. 2 schematically shows an important part in longitudinal cross-section according to Embodiment 1 of the present invention.

Embodiment 1 will be described in reference of FIGS. 1 through 5. FIG. 1 is a longitudinal cross-sectional view according to Embodiment 1 of the present invention; and FIG. 2 is a longitudinal cross-sectional view of an important part according to Embodiment 1 of the present invention. Numerical reference 1 designates a fixed scroll, of which outer periphery is fastened by bolts (not shown) to a guide frame 15. On one surface of a seat 1*a* (lower side in FIG. 1) is formed with a spiral turbine 1*b* and an outer periphery of the seat is formed with a pair of Oldham's coupling groove 1*c* substantially in linear. A pair of fixed projections 9*c* of an Oldham's coupling 9 are engaged with the Oldham's coupling groove 1*c* in a reciprocally slidable manner. Further, a suction tube 10*a* is press-fitted to a hermetically sealed vessel 10 from a direction of a side surface of the fixed scroll 1 (right side in FIG. 1) by penetrating the hermetically sealed vessel 10.

Numerical reference 2 designates a rotating scroll having a seat 2*a*. In one surface of the seat 2*a* (upper side in FIG. 1), a spiral turbine 2*b* having substantially the same shape as that of the spiral turbine 1*b* of the fixed scroll 1 is formed, and in a central portion of the reverse side of the spiral turbine 2*b* of the seat 2*a* (lower side in FIG. 1), a boss 2*f* having a hollow cylindrical shape is formed. In an inner side surface of the boss 2*f*, a bearing 2*c* is formed. In an outer periphery on the same side as that of the boss 2*f* of the rotating scroll, a thrust face 2*d*, which is slidably in contact with a thrust bearing 3*a* of a compliant frame, is formed. Further, in an outer periphery of the seat 2*a* of the rotating scroll 2, a pair of Oldham's coupling groove are formed substantially in linear with a phase shift of 90° in respect of the Oldham's coupling groove 1*c* of the fixed scroll. A pair of rotating projections 9*a* of the Oldham's coupling 9 are engaged with the Oldham's coupling groove 2*e* so as to be reciprocally slidable. The seat 2*a* is formed with an intermediate pressure passage 2*j*, which is a narrow hole connecting a surface on the side of the fixed scroll 1 (upper surface in FIG. 1) to a surface on the side of compliant frame 3 (lower surface in FIG. 1). An aperture on the surface on the side of compliant frame of the intermediate pressure passage 2*j*, i.e. a lower entrance, is positioned so that a circular locus thereof is always within an inside of the thrust bearing 3*a* of the compliant frame 3 in normal operation- The intermediate pressure passage 2*n* can be a single slant hole as shown in FIG. 1 or can be composed of three holes and an intermediate pressure passage 2*l* and there is no substantial difference therebetween.

In a central portion of the compliant frame 3, a main bearing 3*c* and an auxiliary main bearing 3*h*, both for supporting a main shaft rotatably driven by an motor in directions of its radiuses, are formed. Further, a connection passage 3*s* connecting from the surface of the thrust bearing 3*a* to a space 15*f* is formed on the compliant frame 3. Adjust valve housing is also formed in the compliant frame 3, one end of which adjust valve housing 3*p* (lower end in FIG. 2) is connected to a space around boss 2*h* through an adjust valve inlet path 3*j* and simultaneously the other end of which (upper end in FIG. 2) is connected to a space around outer periphery of seat 2*i* through an adjust valve outlet path 3*n*. In a lower portion of the adjust valve housing 3*p*, an intermediate pressure adjusting valve 3*l* is accommodated so as to be reciprocally slidable. In an upper portion of the adjust valve housing 3*p*, a spring stopper 3*t* is accommodated by fixing it to the compliant frame 3. Between the intermediate pressure adjusting valve 3*l* and the spring stopper 3*t*, an intermediate pressure adjusting spring 3*m* is accommodated by being compressed shorter than the expanded length thereof.

Although an outer peripheral surface 15*g* of the guide frame 15 is fixed to the hermetically sealed vessel 10 by an interference shrink fit or a welding, a flow path for introducing a high-pressure refrigerating gas, discharged from a discharge port 1*f* of the fixed scroll 1, from the guide frame 15 to a discharge tube 10*b* installed on a side of motor (lower side in FIG. 1) is maintained. On a side of the fixed scroll in an inner side surface of the guide frame 15 (an upper side in FIG. 1), an upper bore surface 15*a* is formed and engaged with an upper cylindrical surface 3*d* formed in an outer peripheral surface of the compliant frame 3. On the other hand, on a side of the motor side in the inner side surface of the guide frame 15 (lower side in FIG. 1), a lower bore surface 15*b* is formed and engaged with a lower cylindrical surface 3*e* formed in the outer peripheral surface of the compliant frame 3. In an inner side surface of the guide frame 15, two seal grooves having a ringed shape for accommodating seals are formed, in which seal grooves, an upper seal 16*a* having a ringed shape and a lower seal having a ringed shape are inserted and seated. An area formed among these two seals, the inner side surface of the guide frame 15, and the outer side surface of the compliant frame 3 is the space 15*f*. The upper seal 16*a* and the lower seal 16*b* is not necessarily indispensable and can be omitted by sealing a micro-gap between engaged portions, for example, by forming an oil film. A space on the outer peripheral side of the thrust bearing 3*a* surrounded by the seat 2*a* of the rotating scroll and the compliant frame in the vertical directions, namely a space around outer periphery of seat 2*i*, is connected to a suction chamber 1*g* in the vicinity of the outer end of the spiral turbine, whereby it has a low pressure under an atmosphere of suction gas.

In an end on the side of the rotating scroll of the main shaft 4 (upper side in FIG. 1), an orbit shaft body 4*b* rotatably engaged with the bearing 2*c* of the rotating scroll 2*c* is formed. Beneath the end, a main shaft balancer 4*e* is fixed by an interference shrink fit, and a main shaft body 4*c* rotatably engaged with the main bearing 3*c* and the auxiliary main bearing 3*h*, both of the compliant frame 3, is formed. In the other end of the main shaft, a subshaft body 4*d* rotatably engaged with a subbearing 6*a* of a subframe 6 is formed. Between the subshaft body 4*d* and the main shaft body 4*c*, a rotor of motor 8 is fixed by an interference shrink fit. To an upper end surface of the rotor of motor 8, an upper balancer 8*a* is fastened, and to a lower end of the rotor, a lower balancer 8*b* is fastened, wherein three balancers including the main shaft balancer 4*e* adjust a static balance and a dynamic balance. Further, an oil pipe 4*f* is press-fitted into the end surface of the main shaft 4 in order to suck up a refrigerating oil 10*e* accumulated in a bottom portion of the hermetically sealed vessel 10. It is possible to omit the oil pipe 4*f* by extending the main shaft 4. A glass terminal 10*f* is attached to a side surface of the hermetically sealed vessel 10, to which glass terminal a lead wire from a stator of motor 7 is connected.

In the next, normal operation of the scroll compressor according to Embodiment 1 will be described. In the normal operation, because an area of hermetically sealed vessel 10*a* has a high pressure under an atmosphere of discharge gas, the refrigerating oil 10*e* in the bottom portion of the hermetically sealed vessel 10 is introduced into a space in boss 2*g* through a high pressure lubrication hole 4*g*, penetrating the oil pipe 4*f* and the main shaft 4 in the axial direction. This high-pressure oil is depressurized by the bearing 2*c* so as to be an intermediate pressure higher than a suction pressure and the same as a discharge pressure or less and flows into the space around boss 2*h*. On the other hand, a high-pressure oil in the high pressure lubrication hole 4*g* is introduced into an end having a high pressure of the main bearing 3*c* (lower end surface in FIG. 1) from a side aperture formed in the main shaft 4, wherein it becomes to have the intermediate pressure by being depressurized by the main bearing 3*c* and flows into the space around boss 2*h*. The refrigerating oil having the intermediate pressure of the space around boss 2*h*, which refrigerating oil is generally in a two phase state including a gas refrigerant and the refrigerating oil by gassing of the refrigerant dissolved in the refrigerating oil, passes through an adjust valve inlet path 3*j*; flows into adjust valve housing 3*p* in an atmosphere of the suction pressure i.e. a low pressure by defeating a load applied by an intermediate pressure adjusting spring 3*m* to push up an intermediate pressure adjusting valve 3*l*; and is released in the space around outer periphery of seat 2*i* through an adjust valve outlet path 3*n*. As described, the intermediate pressure Pm1 of the space around boss 2*h* is controlled by a predetermined pressure $\alpha$ substantially determined by spring force of the intermediate pressure adjusting spring 3*m* and an area exposed to the intermediate pressure of the intermediate pressure adjusting valve 3*l* as follows:

$Pm1=Ps+\alpha$, where reference Ps designates a pressure of suction atmosphere, i.e. a low pressure.

In Embodiment 1, it is possible to realize stable lubrication to the bearings because pressures has a relationship of: suction area (space around outer periphery of seat 2*i*)<space around boss<discharge area (area of hermetically sealed vessel 10*d*); and the refrigerating oil in the atmosphere of high pressure in the discharge area stably flows into the space around boss by a predetermined pressure difference determined by a pressure adjusting device.

Incidentally, an entrance 2*k* of the intermediate pressure passage 2*j* installed in the seat 2*a* of the rotating scroll 2 is constantly or intermittently connected to an opening portion on a thrust bearing side of the connection passage 3*s* formed in the compliant frame 3 i.e. an entrance 3*u* (upper opening portion in FIG. 2). Therefore, a refrigerant gas having an intermediate pressure higher than a suction pressure in a middle of compressing operation in the compression chamber, which is composed of the fixed scroll 1 and the rotating scroll 2, and the same as a discharge pressure or less is introduced into the space 15*f* through the intermediate pressure passage 2*j* of the rotating scroll 2 and the connection passage 3*s* of the compliant frame 3. However, because the space 15*f* is a closed area sealed by the upper seal 16*a* and the lower seal 16*b*, the compression chamber and the space 15*f* is in so-called breezing state, in which there are bidirectional minute flows between the compression chamber and the space in response to a pressure variation of the compression chamber in the normal operation. As described, an intermediate pressure Pm2 in the space 15*f* is controlled by a predetermined magnification β substantially determined by a position of the connecting compression chamber as follows:

Pm2=Ps×β, where reference Ps designates a pressure of suction atmosphere i.e. a low pressure.

Although the sum of force caused by the intermediate pressure Pm1 in the space around boss 2*h* and a pressure of pushing from the rotating scroll 2 through the thrust bearing 3*a* effects on as downward force, the sum of force caused by the intermediate pressure Pm2 in the space 15*f* and force caused by a high pressure acting on a portion exposed to the atmosphere of high pressure on the end surface effects on as upward force, wherein the upward force is set to be larger than the downward force in the normal operation. Therefore, the upper cylindrical surface 3*d* of the compliant frame 3 is guided by the upper bore surface 15*a* and the lower cylindrical surface 3*e* of the compliant frame 3 is guided by the lower bore surface 15*b*. In other words, the compliant frame 3 can slide on the guide frame 15 and floats on a side of fixed scroll (upward direction in FIG. 1). The rotating scroll 2 pushed up by the compliant frame 3 through the thrust bearing 3*a* also floats upward. Consequently, tops and bottom of the rotating scroll 2 is slidably in contact with bottom and tops of the fixed scroll 1 respectively. In Embodiment 1, because the space around boss 2*h*, of which inner pressure is the intermediate pressure higher than a suction pressure, is formed, there is an effect that the rotating scroll is separated from the compliant frame in the axial direction; and contact force between the thrust surface of the rotating scroll and the thrust bearing of the compliant frame is partially reduced, whereby a sliding loss of the rotating scroll can be reduced and seizure of the thrust bearing caused by an excessive load can be avoided.

In the next, basic operation in starting up will be described in reference of FIG. 2. Generally, before starting up, a pressure in the hermetically sealed vessel 10 is uniform, which pressure is so-called balance pressure. The suction atmosphere and the discharge atmosphere have the same pressure. The pressure of the suction atmosphere decreases along with compressing operation just after starting up, and the pressure of the discharge atmosphere increases along with the compressing operation. In the scroll compressor of frame compliant type according to Embodiment 1, a pressure slightly higher than the balance pressure of just before starting up, i.e. the balance pressure×β, is introduced into the space 15*f* just after starting up. In the conventional scroll compressor of frame compliant type, an inner pressure in the hermetically sealed vessel 10, namely a pressure of the discharge atmosphere, is increased and thereafter a pressure in the space 15*f* is increased. However, in Embodiment 1, the pressure in the space 15*f* increases earlier than a rise of the pressure of the discharge atmosphere. Therefore, the compliant frame 3 is lifted up within a relatively short period and the rotating scroll 2 is lifted up along therewith so as to be slidably in contact with the fixed scroll 1 in the axial direction, whereby the normal operation is ready. Thus a highly efficient compression having an excellent starting-up property is realized.

If, in the conventional scroll compressor of frame compliant type, namely a compressor of which space around boss 2*h* and space 15*f* are connected by a pressure equalizing aperture 3*i* to make these substantially the same area, an intermediate pressure in the space around boss 2*h* and an intermediate pressure in the space 15*f* are generated by introducing a refrigerant gas in course of compression (intermediate pressure=suction pressure ×β). Therefore, although it seems that a compressor having an excellent starting-up property is obtainable in a similar manner to those described in Embodiment 1 since the pressure in the space 15*f* is increased just after starting up, there are the following two problems.

The first problem is that since the pressure around boss 2*h* is increased in synchronism with increment of the pressure in the space 15*f*, force of separating the rotating scroll 2 from the compliant frame 3 is increased and thereby the rotating scroll becomes unstable. Therefore, a gap causing a leak between the thrust surface 2*d* of the rotating scroll 2 and the thrust bearing 3*a* of the compliant frame 3 is increased; the intermediate pressure in the space 15*f* is decreased to thereby deteriorate the starting-up property; and a danger in terms of reliability by an insufficient contact of the bearings may be caused.

The second problem is that a state that the pressure in the space around boss 2*h* is higher than the pressure of the refrigerating oil 10*e* accumulated in the bottom portion of the hermetically sealed vessel 10, i.e. the discharge pressure in the hermetically sealed vessel, continues for a certain amount of time after starting up since the pressure in the space around boss 2*h* increases in synchronism with the pressure increment in the space 15*f*. Accordingly, lubrication by a pressure difference of the refrigerating oil 10*e* is not instantaneously started and the bearing 2*c* and the main bearing 3*c* are not supplied with the refrigerating oil for this moment even though the scroll compressor is in a running state, whereby troubles in terms of reliability such as wear and seizure of the bearings are caused. On the contrary, in Embodiment 1 of the present invention, a highly efficient compressor having high reliability, in which an improvement in the starting-up property and lubricating just after starting up, is assured is realized.

In the scroll compressor of frame compliant type according to Embodiment 1 of the present invention, when the rotating scroll 2 flaps on the thrust bearing 3*a* of the compliant frame by an outer disturbance although the intermediate pressure Pm1 in the space around boss 2*h* is decreased, the intermediate pressure Pm2 in the space 15*f* is not decreased, whereby the rotating scroll does not easily relieve. Thus a highly efficient compressor having high reliability is realized.

Additionally, the space around boss 2*h* and the space 15*f* are not connected each other and are formed as independent areas in terms of pressure. Therefore, a compact compressor at a low cost having a high degree of freedom in setting areas, on which a pressure in the axial directions effects, within various spaces is realized. In Embodiment 1, an example that the space around boss 2*h* is made to be the intermediate pressure by adopting the intermediate pressure adjusting spring 3*m* and the intermediate pressure adjusting valve 3*l* is described. However, a similar effect is obtainable by adopting a structure that the space around boss 2*h* is made to be a space having a low pressure (atmosphere of intake) as in the space around outer periphery of seat 2*i* by directly connecting the space around boss 2*h* to the space around outer periphery of seat 2*i* without adopting neither the intermediate pressure adjusting spring 3*m* nor the intermediate pressure adjusting valve 3*l*.

Figure 3A:
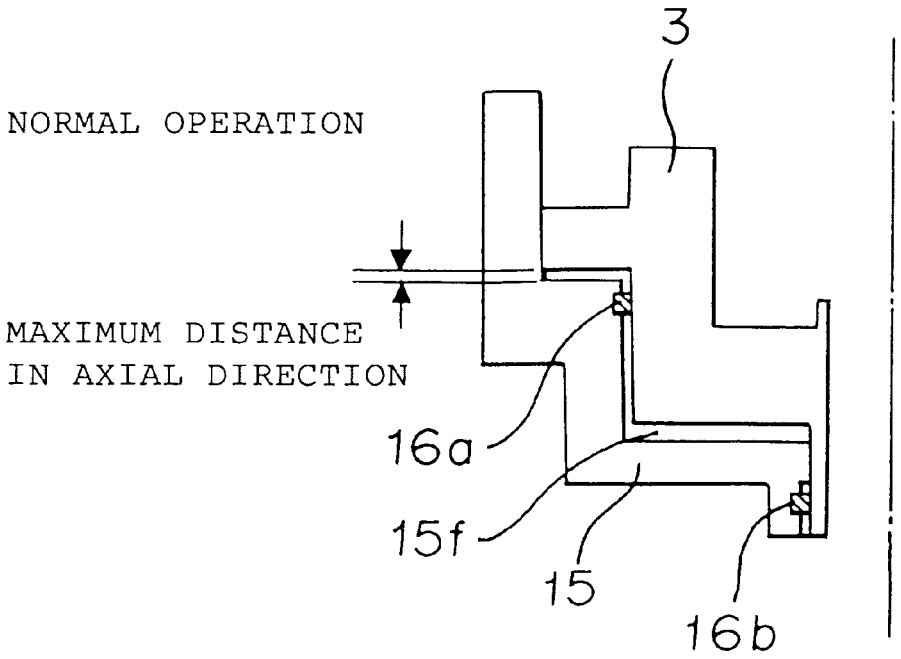
FIG. 3*a* schematically shows the maximum movable distance in an axial direction according to Embodiment 1 of the present invention.
Figure 3B:
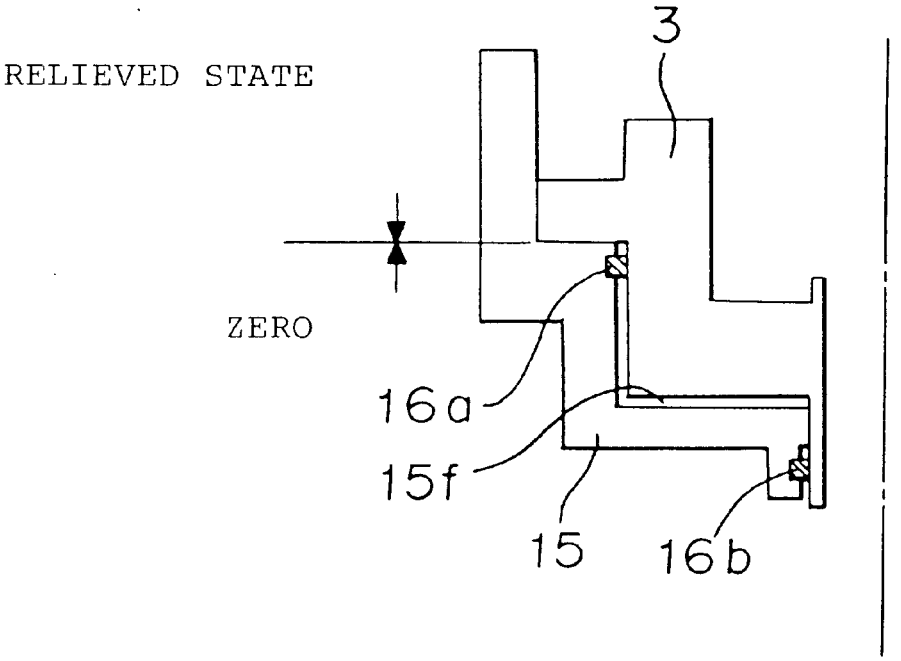
FIG. 3*b* schematically shows the maximum movable distance in an axial direction according to Embodiment 1 of the present invention.

In the next, the maximum movable distance in the axial direction will be described with reference to FIGS. 3*a* through 5. In the normal operation, the compliant frame 3 floats along with the rotating scroll 2 as shown in FIG. 3*a*, wherein there is a gap having the maximum movable distance in the axial direction, i.e. the maximum amount of relieving in the axial direction, exists between the compliant frame 3 and the guide frame 15. On the other hand, because the compliant frame 3 is in contact with the guide frame 15 in the axial direction under the relieved state, there is no gap in the axial direction therebetween as shown in FIG. 3*b*.

Figure 4:
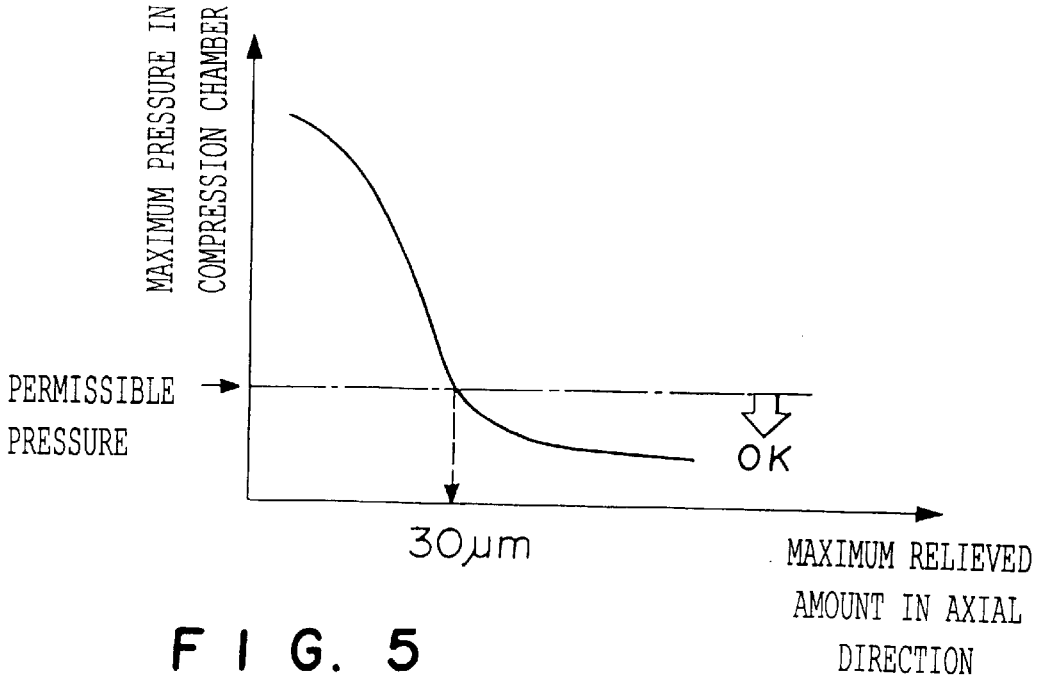
FIG. 4 is a diagram for explaining a rise of an inner pressure when a liquid refrigerant is compressed.

FIG. 4 shows a rise of the inner pressure at a time of compressing a liquid refrigerant. In FIG. 4, the abscissa represents the maximum amount of relieving in the axial direction, which is an interval in the axial direction between the compliant frame and the guide frame under the normal operation, and the ordinate represents the maximum pressure generated in the compression chamber at a time of compressing a liquid refrigerant, a refrigerating oil and so on. As shown, when the maximum amount of relieving in the axial direction is 30 $\mu$m or less, because the maximum pressure generated in the compression chamber exceeds a permissible pressure, there is a danger that troubles in terms of reliability such as destruction including fatigue failures of the spiral turbine of the fixed scroll and the spiral turbine of the rotating scroll and abnormal wear and seizure caused along with an increment of a load to the bearings. In the scroll compressor of frame compliant type according to Embodiment 1 of the present invention, because the maximum amount of relieving in the axial direction is set to be 30 $\mu$m or more, there is no danger of causing the above-mentioned troubles in reliability. Generally, in the scroll compressor of which rotating scroll was independently movable in the axial direction, there was a danger that the shaft is seized by an increment of occasions that the bearing was partially held when the rotating scroll was relieved under a condition that the maximum amount of relieving in the axial direction of the rotating scroll was set to be large. In scroll compressors of frame compliant type not limited to that described in Embodiment 1, a degree that the bearing is partially held is not increased because the rotating scroll and the compliant frame integrally move in the vertical directions at a time of relieving.

Figure 5:
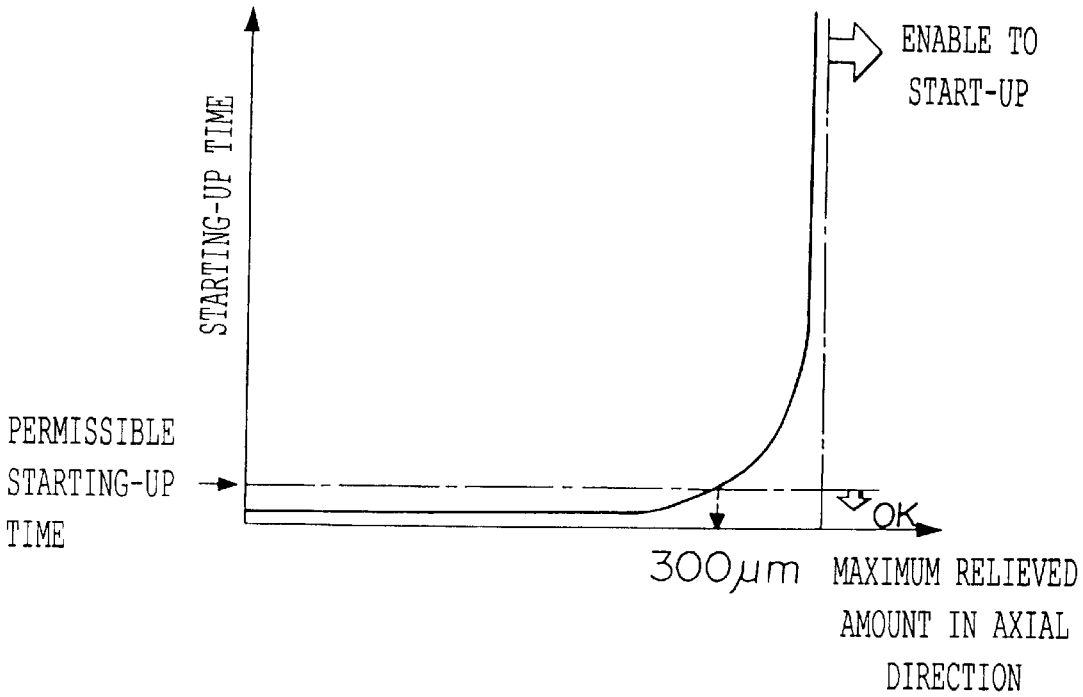
FIG. 5 is a diagram for explaining a starting-up property according to Embodiment 1 of the present invention.

FIG. 5 shows a starting-up property. The abscissa represents the maximum amount of relieving in the axial direction as in FIG. 4, and the ordinate represents a time required for starting-up, i.e. a time from starting-up through floating of the compliant frame to the normal operation, specifically the time required for starting-up means a period necessary for transferring from a relieved state to an ordinary running in which a compliant frame and a rotating scroll integrally float and tops and a bottom of the rotating scroll are slidably in contact with a bottom and tops of a fixed scroll respectively. As shown in FIG. 5, because the starting-up time exceeds a permissible start-up time when the maximum amount of relieving in the axial direction is 300 $\mu$m or more, there is dangers that a starting-up property is not sufficient or the starting-up is impossible as a defective in some occasions. Because the maximum amount of relieving in the axial direction is set to be 300 $\mu$m or less in the scroll compressor of frame compliant type according to Embodiment 1, there is no danger of causing such troubles in terms of reliability and deficiency.

Although a part or all of overturning moment generated in the rotating scroll 2 is transmitted through the thrust bearing 3*a* to the compliant frame 3, because resultant force of a load received from the main bearing 3*c* and a reaction to the load, namely coupled force of reaction force received from the guide frame 15 through the upper cylindrical surface 3*d* and reaction force received from the guide frame 15 through the lower cylindrical surface 3*e*, effects to cancel the overturning moment, excellent stability in follow-up operation in the normal operation and excellent stability in relieving are obtainable as in the conventional scroll compressor of frame compliant type.

Embodiment 2

Figure 6:
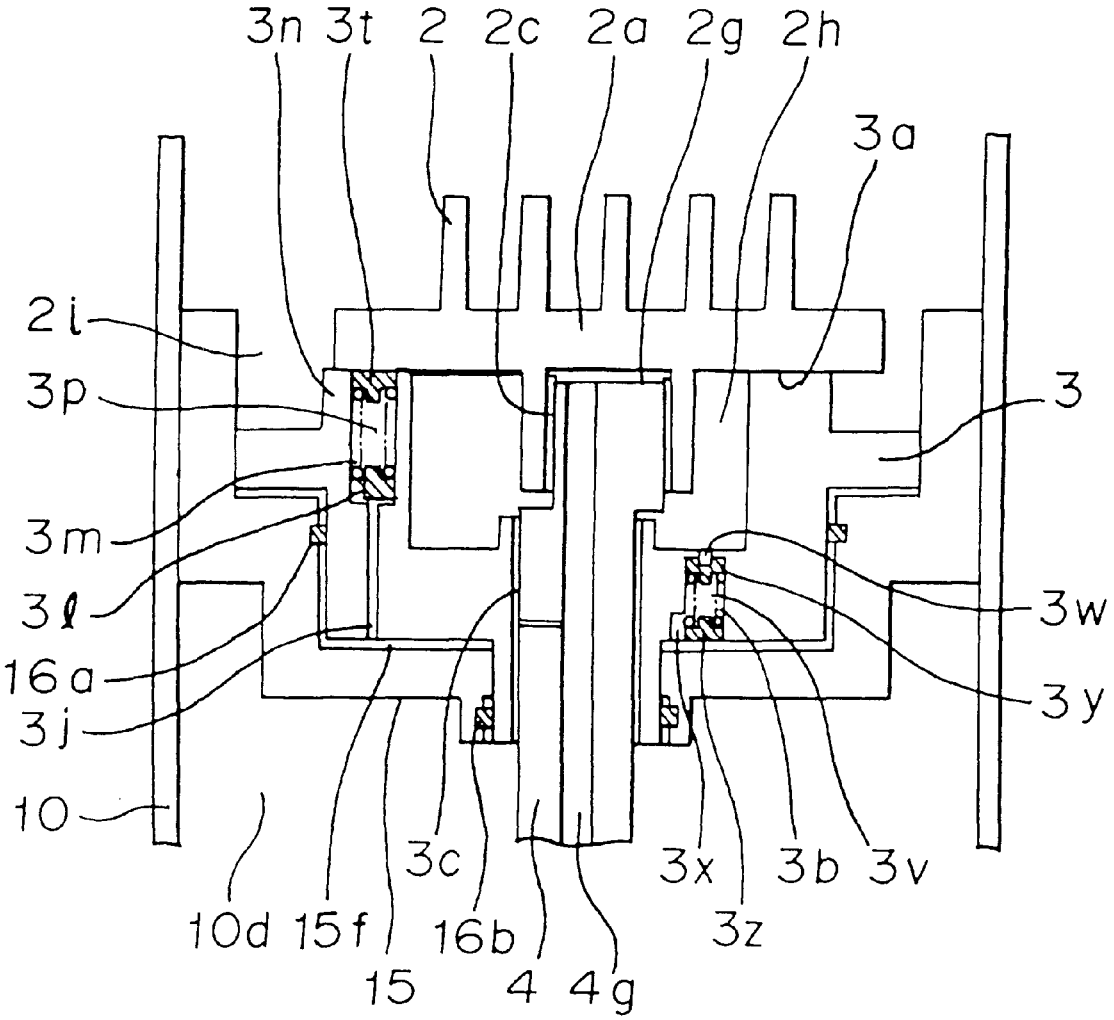
FIG. 6 schematically shows an important part in longitudinal cross-section according to Embodiment 2 of the present invention.

Embodiment 2 of the present invention will be described in reference of FIG. 6. FIG. 6 is a longitudinal cross-sectional view of an important part according to Embodiment 2 of the present invention. The other parts are similar to those described in Embodiment 1 and description is omitted. Adjust valve housing 3*p* is formed in the compliant frame 3. An end of the adjust valve housing 3*p* (lower end in FIG. 6) is connected to the space 15*f* through an adjust valve inlet path 3*j*, and the other end thereof (upper end in FIG. 6) is connected to the space around outer periphery of seat 2*a* through an adjust valve outlet path 3*n*. In a lower part of the adjust valve housing 3*p*, an intermediate pressure adjusting valve 3*l* is slidably accommodated, in an upper portion, a spring stopper 3*t* is accommodated, which spring stopper is secured to the compliant frame 3. An intermediate pressure adjusting spring 3*m* is accommodated in the intermediate adjusting valve 3*l* and the spring stopper 3*t* by being compressed shorter than the expanded length. Further, check valve housing 3*v* is formed in the compliant frame 3, wherein an end of the check valve housing 3*v* (upper end in FIG. 6) is connected to the space around boss 2*h* through a check valve inlet path 3*w*, and the other end (lower end in FIG. 6) is connected to the space 15*f* through a check valve outlet path 3*x*. In an upper portion of the check valve housing 3*v*, a check valve 3*y* is slidably accommodated, and in a lower portion, a spring stopper 3*z* is accommodated, which spring stopper 3*z* is secured to the compliant frame 3. A check valve spring 3*b* is accommodated between the check valve 3*y* and the spring stopper 3*z* by being compressed shorter than the expanded length.

To seal grooves in a ringed shape for accommodating seal are formed in an inner side surface of the guide frame 15, to which seal grooves an upper seal 16*a* of a ringed shape and a lower seal of a ringed shape are fitted respectively. The two seals, an inner side surface of the guide frame 15, and an outer side surface of the compliant frame 3 form the space 15*f*. However, the upper seal 16*a* and the lower seal 16*b* are not necessarily indispensable, and these can be omitted by sealing micro-gaps of engaging portions, for example, by forming an oil film. An area on an outer peripheral side of the thrust bearing surrounded by the seat 2*a* of the rotating scroll and the compliant frame 3 in the vertical directions, i.e. the space around outer periphery of seat 2*i*, is connected to a suction area in the vicinity of an outer end of the spiral turbine and therefore is in an atmosphere of suction gas.

In the next, the normal operation of the scroll compressor according to Embodiment 2 will be described. Because a space of hermetically sealed vessel 10*d* has a high pressure under an atmosphere of discharge gas in the normal operation, a refrigerating oil in a bottom portion of the hermetically sealed vessel is introduced into a space in boss 2*g* through a high pressure lubrication hole 4*g* formed in the main shaft by penetrating in the axial direction. A high pressure oil is depressurized by a bearing 2*c* to be an intermediate pressure higher than a suction pressure and the same as a discharge pressure or less, whereby it flows into a space around boss 2*h*. On the other hand, as another route, the high pressure oil from the high pressure lubrication hole 4*g* is introduced into an end face on a side of high pressure of a main bearing (lower end in FIG. 6) through a side hole formed in the main shaft 4 and depressurized by the main bearing 3*c* to be the intermediate pressure, whereby the high pressure oil flows into the space around boss 2*h*.

The refrigerating oil, which is generally in a two-phase state of a gas refrigerant and the refrigerating oil by gassing of the refrigerant dissolved in the refrigerating oil, having the intermediate pressure in the space around boss 2*h* passed through a check valve inlet path 3*w*, flows into the check valve housing 3*v* by defeating force applied by the check valve spring 3*b* and pushing up the check valve 3*y*, and thereafter is released in the space 15*f* having the other intermediate pressure higher than the suction pressure and the same as the discharge pressure or less. Thereafter, the refrigerating oil having the other intermediate pressure in the space 15*f*, which refrigerating oil is generally in a two-phase state of a gas refrigerant and the refrigerating oil by gassing of the refrigerant dissolved in the refrigerating oil, passed through the adjust valve inlet path 3*j*, flows into the adjust valve housing 3*p* in an atmosphere of suction pressure, i.e. a low pressure, by defeating force applied by the intermediate pressure adjusting spring 3*m* and pushing up the intermediate pressure adjusting valve 3*l*, and is released in the space around outer periphery of seat through the adjust valve outlet path 3*n*.

As described, the intermediate pressure Pm2 in the space 15*f* is controlled by a predetermined pressure $\alpha 1$ substantially determined by spring force of the intermediate pressure adjusting spring 3*m* and an area exposed to the space of the intermediate pressure adjusting valve 3*l* as follows:

$Pm2=Ps+\alpha 1$, where reference Ps designates a pressure of suction atmosphere i.e. a low pressure.

Incidentally, the intermediate pressure Pm1 in the space around boss 2*h* is controlled by a predetermined pressure $\alpha 2$ substantially determined by spring force of the check valve spring 3*b* and an area exposed to the space around boss of the check valve as follows:

$Pm1=Pm2+\alpha 2=Ps+(\alpha 1+\alpha 2)$, where reference Ps designates a pressure of suction atmosphere.

As described, in the scroll compressor of frame compliant type according to Embodiment 2 of the present invention, because the check valve for allowing a flow of fluid from the space around boss 2*h* to the space 15*f* and simultaneously preventing the adverse flow, which is a flow of fluid from the space 15*f* to the space around boss 2*h*, is installed, although the intermediate pressure Pm1 in the space around boss 2*h* is decreased in a case that the rotating scroll 2 flaps on the thrust bearing 3*a* of the compliant frame 3 by an outer disturbance, the intermediate pressure Pm2 in the space 15*f* is not decreased by such a decrement and therefore the rotating scroll 2 is not easily relieved. Further, a highly efficient compressor having high reliability in which lubrication function is not spoiled, is realized. Because the reference $\alpha 2$ can be easily and freely adjusted by setting the spring force of the check valve spring, the space around boss 2*h* and the space 15*f* can be practically treated as independent areas. Accordingly, a compact compressor at a low cost, in which a degree of freedom in setting areas receiving a pressure in the axial directions within the two areas having the intermediate pressures, is realized.

Further, because the bottom portion of the hermetically sealed vessel accumulating the refrigerating oil is made to be a high pressure, of which magnitude is around that of the discharge pressure; the space around boss is in a middle of the lubrication route; and the space is connected to the area having a low pressure through a pressure adjusting device in Embodiment 2, the pressures always have a relationship of: suction area (space around outer periphery of seat 2*i*)<space<space around boss<discharge area (space of hermetically sealed vessel 10*d*). Therefore, lubrication to the bearings becomes stable because the refrigerating oil in the atmosphere of high pressure in the discharge area stably flows into the space around boss by a predetermined pressure difference determined by the pressure adjusting device and the check valve.

In Embodiment 2, the check valve is used as a means for allowing the flow of fluid to the space around boss 15*f* and preventing the adverse flow, i.e. the flow of fluid from the space 15*f* to the space around boss 2*h*. However, the means is not limited to the check valve and other means can be used as long as a similar effect is obtainable.

In the next, operation at a time of starting up will be described in reference of FIG. 6. Generally, an inner pressure of the hermetically sealed vessel 10 is uniform just before starting up, which inner pressure is so-called balance pressure. Therefore, the suction atmosphere has the same pressure as that of the discharge atmosphere. Just after starting up, the pressure of the suction atmosphere decreases along with compressing operation, and the pressure in the discharge atmosphere increases along with the compressing operation. In the scroll compressor of frame compliant type according to Embodiment 2, the intermediate pressure Pm1 in the space around boss 2*h* decreases by following a drop of the pressure in the suction atmosphere, and an accompanying pressure decreases in the space around outer periphery of seat just after starting up. On the other hand, the pressure in the discharge atmosphere increases just after starting up, wherein the pressure difference for supplying the refrigerating oil accumulated in the bottom portion of the hermetically sealed vessel 10 to the bearing 2*c* and the main bearing 3*c* is obtainable just after starting up. Thus, a compressor having high reliability, in which lubrication to the bearings is sufficiently assured even in timing of just after starting up, is obtainable.

As described, two sets of a valve and a spring module are respectively installed between the space around boss 2*h* and the space 15*f* for generating the pressure difference of $\alpha 2$ and between the space 15*f* and the area of low pressure atmosphere for generating the pressure difference of $\alpha 1$, and the compressor is controlled by the formulas of $Pm1=Ps+(\alpha 1+\alpha 2)$; and $Pm2=Ps+\alpha 1$. However, a similar effect is obtainable as another method by respectively installing two sets of a valve and a spring module between the space around boss 2*h* and the space of low pressure atmosphere for generating the pressure difference of $\alpha 2$ and between the space 15*f* and the space of low pressure atmosphere for generating the pressure difference of $\alpha 1$ and also by controlling the compressor in accordance with formulas of $Pm1=Ps+\alpha 2$; and $Pm2=Ps+\alpha 1$.

In this case, a simple structure that a refrigerating oil depressurized by the bearing 2*c* to be an intermediate pressure is introduced into the space around boss and a refrigerating oil depressurized by the main bearing 3*c* to be an intermediate pressure is introduced into the space is obtainable.

Embodiment 3

Figure 7:
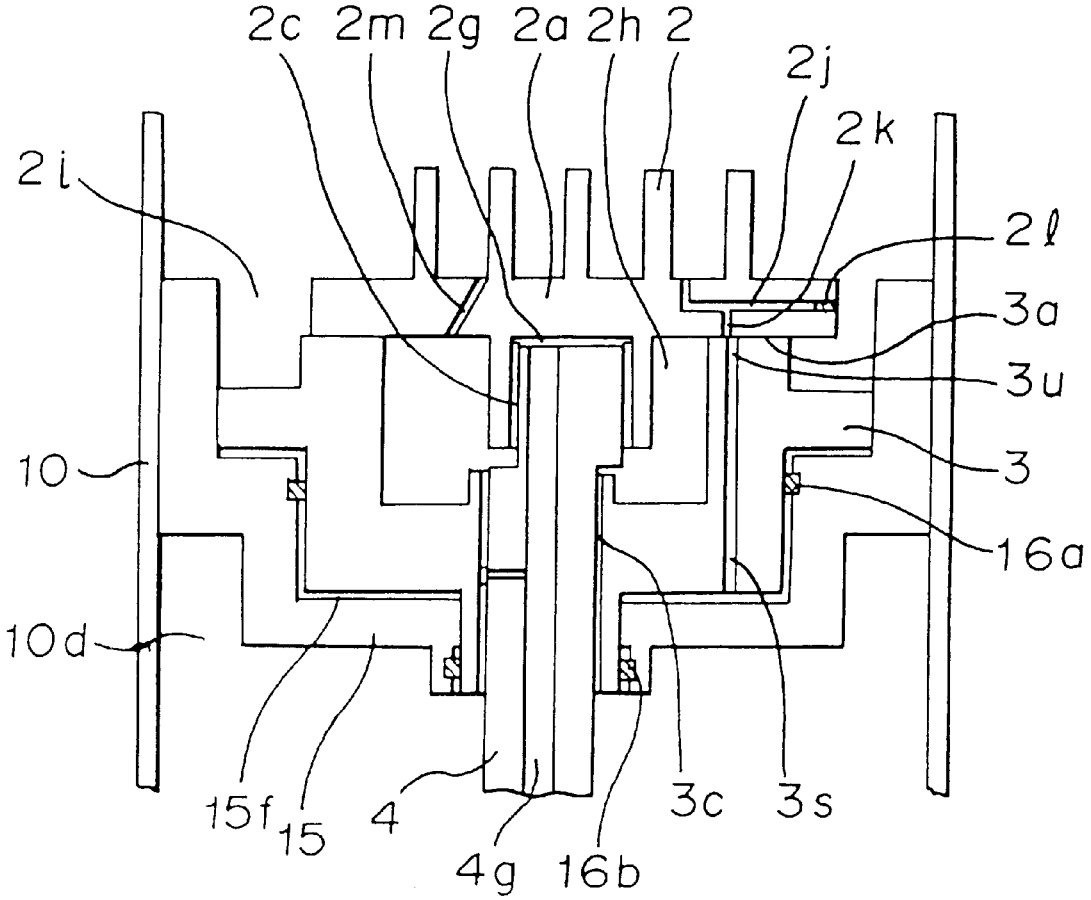
FIG. 7 schematically shows an important part in longitudinal cross-section according to Embodiment 3 of the present invention.
Figure 8:
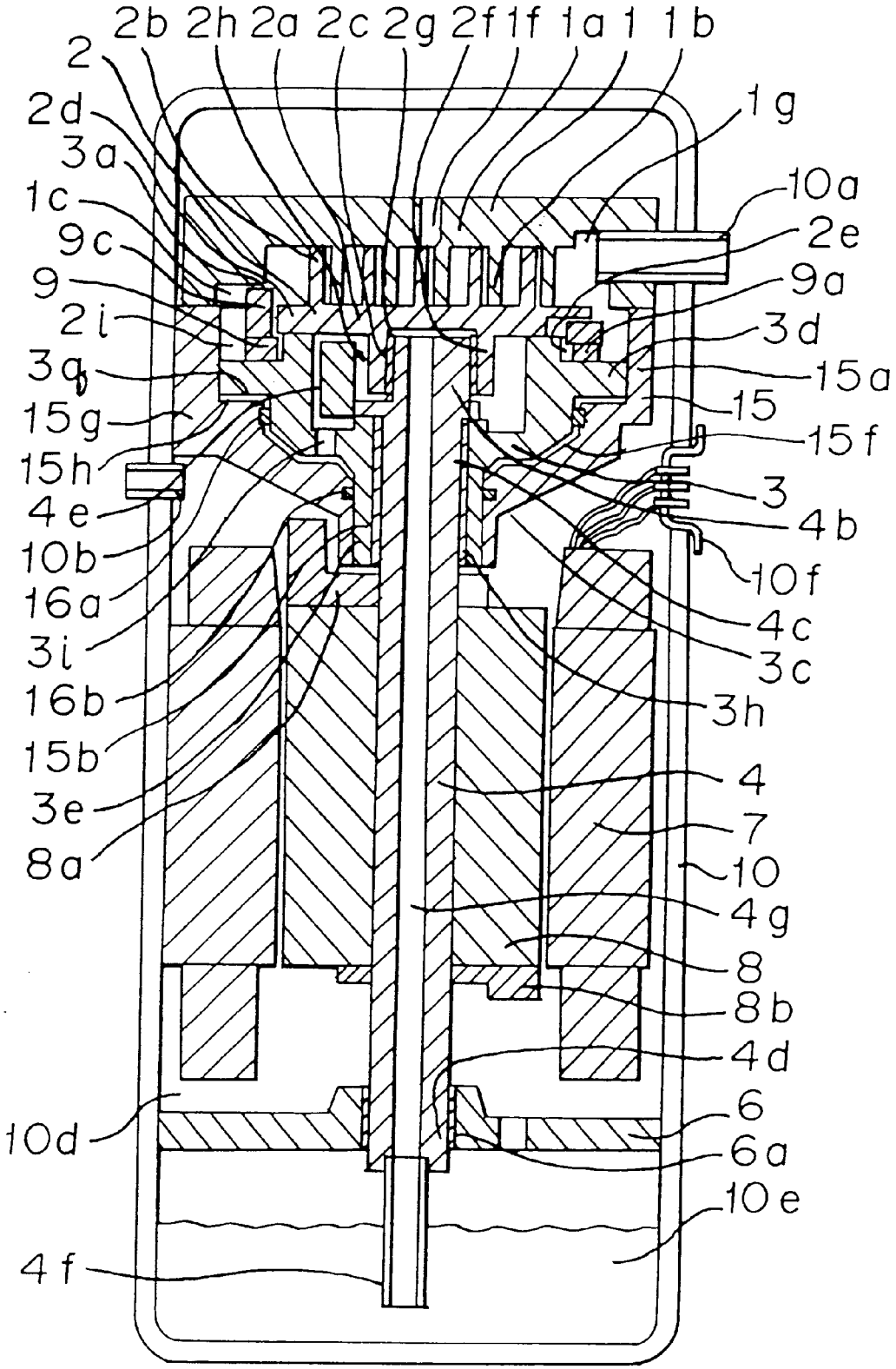
FIG. 8 PRIOR ART
FIG. 8 is a longitudinal cross-sectional view for showing a conventional scroll compressor.

Embodiment 3 of the present invention will be described with reference to FIG. 7. FIG. 7 is a longitudinal cross-sectional view of an important part of Embodiment 3 of the present invention. The other parts are similar to those described in Embodiment 1 and description is omitted.

In the seat 2*a* of the rotating scroll 2, an intermediate pressure passage for connecting a surface on the side of fixed scroll (upper surface in FIG. 7) to a surface on the side of compliant frame 3 (lower surface in FIG. 7), which is a narrow aperture, is formed. An opening portion on the surface on the side of compliant frame of the intermediate pressure passage 2*j*, i.e. a lower entrance 2*k*, is positioned so that a circular locus thereof is always included in the thrust bearing 3*a* of the compliant frame 3 in the normal operation. Further, a second intermediate pressure passage 2*m* which is another narrow hole for connecting the surface on the side of fixed scroll (upper surface in FIG. 7) to the surface on the side of compliant frame 3 (lower surface in FIG. 7) is formed in the seat. An opening portion on the surface of the side of compliant frame of the second intermediate pressure passage 2*m* is positioned so that a circular locus thereof is constantly or intermittently connected to the space around boss 2*h* in the normal operation. Further, a connection passage 3*s* for connecting the surface of the thrust bearing 3*a* to the space 15*f* is formed in the compliant frame 3 .

Two seal grooves in a ringed shape for accommodating seals are formed in an inner side surface of the guide frame 15, to which seal grooves an upper seal 16*a* of a ringed shape and a lower seal 16*b* of a ringed shape are fitted. These two seals, the inner side surface of the guide frame 15, and an outer side surface of the compliant frame 3 form the space 15*f*. However, the upper seal 16*a* and the lower seal 16*b* are not necessarily indispensable and can be omitted by sealing a micro-gap in engaging portions, for example, by forming an oil film. An area on an outside of an outer periphery of the thrust bearing 3*a*, which is surrounded by the seat 2*a* of the rotating scroll and the compliant frame 3 in the vertical directions, namely the space around outer periphery of seat 2*a*, is in an atmosphere of suction gas because it is connected to a suction area in the vicinity of an outer end of the spiral turbine.

In the next, operation of the scroll compressor according to Embodiment 3 in the normal operation will be described. Because the space of hermetically sealed vessel 10*d* has a high pressure of an atmosphere of discharge gas in the normal operation, a refrigerating oil in a bottom portion of the hermetically sealed vessel is introduced into a space in boss through a high pressure lubrication hole 4*g* formed in the main shaft 4 by penetrating in the axial direction. A high pressure oil is depressurized by a bearing 2*c* to be an intermediate pressure and flows into a space around boss. On the other hand, as another route, the high pressure oil from the high pressure lubrication hole 4*g* is introduced into an end surface on a side of high pressure of a main bearing (lower end in FIG. 7) through a side hole formed in the main shaft 4, is depressurized by the main bearing 3*c* to be an intermediate pressure, and similarly flows into the space around boss 2*h*.

The refrigerating oil having the intermediate pressure in the space around boss 2*h*, which is generally in a two phase state of a gas refrigerant and the refrigerating oil by gassing of the refrigerant dissolved in the refrigerating oil, flows into the compression chamber formed by the fixed scroll 1 and the rotating scroll 2 through the second intermediate pressure passage 2*m*. In other words, the refrigerating oil is injected into a refrigerant gas in a middle of compressing operation. As described, the intermediate pressure Pm1 in the space round boss 2*h* is controlled by a predetermined magnification β1 substantially determined by a position of the compression chamber substantially connected to the second intermediate pressure passage 2*m*, the amount of the refrigerating oil to be injected and so on as follows:

$Pm1=Ps+\beta 1$, where reference Ps designates a pressure of suction atmosphere i.e. a low pressure.

On the other hand, the entrance 2*k* of the intermediate pressure passage 2*j* formed in the seat 2*a* of the rotating scroll 2 is constantly or intermittently connected to an opening portion on a side of thrust bearing of the connection passage 3*s* formed in the compliant frame 3, i.e. an entrance 3*u* (an upper opening portion in FIG. 7). Therefore, the refrigerant gas in a middle of compressing operation from the compression chamber formed by the fixed scroll 1 and the rotating scroll 2 is introduced into the space 15*f* through the intermediate pressure passage 2*j* in the rotating scroll 2 and the connection passage 3*s* in the compliant frame 3. However, because the space 15*f* is a closed area sealed by the upper seal 16*a* and the lower seal 16*b*, there is a minute bidirectional flows between the compression chamber and the space 15*f* in response to a pressure variation in the compression chamber in the normal operation as if breathing. As described, the intermediate pressure Pm2 in the space 15*f* is controlled by a predetermined magnification β2 substantially determined by a position of the compression chamber substantially connected to the intermediate pressure passage 2*j* as follows:

$Pm2=Ps\times\beta 2$, where reference Ps designates a pressure of suction atmosphere i.e. a low pressure.

As described, in the scroll compressor of frame compliant type according to Embodiment 3 of the present invention, because the space around boss 2*h* and the space 15*f* are independently formed by separate areas, when the rotating scroll 2 flaps on the thrust bearing 3*a* of the compliant frame 3 by an outer disturbance, although the intimidate pressure Pm1 in the space around boss 2*h* is decreased, the intermediate pressure Pm2 in the space 15*f* is not decreased by such a decrement, whereby the rotating scroll is not easily relieved. Thus a highly efficient compressor having high reliability is realized.

In the next, operation in starting up will be described in reference of FIG. 7. Generally, an inner pressure of the hermetically sealed vessel 10 is uniform just before starting up, which pressure is so-called balance pressure. In other words, an suction atmosphere and a discharge atmosphere have the same pressure. Just after starting up, a pressure in the suction atmosphere decreases along with compressing operation, and a pressure in the discharge atmosphere increases along with the compressing operation. In the scroll compressor of frame compliant type according to Embodiment 3, a pressure a slightly higher than the balance pressure of just before starting up, i.e. balance pressure×β2, is introduced into the space 15*f* just after starting up. Accordingly, a pressure in the space 15*f* increases earlier than the pressure in the discharge atmosphere, whereby the compliant frame 3 is lifted up within a relatively short period and simultaneously the rotating scroll 2 is lifted up so as to be slidably in contact with the fixed scroll 1 in the axial direction, whereby a state of the normal operation is prepared. Thus a highly efficient compressor having an excellent starting-up property is realized.

Additionally, because the space around boss 2*h* and the space 15*f* are formed as independent areas, a compact compressor at a low cost, which has a high degree of freedom in setting areas receiving a pressure in the axial directions within the respective areas having the intermediate pressures, is realized.

In Embodiments 1 through 3, a hermetic compressor mainly used in small size and medium size refrigerating machines and air conditioners is exemplified. However, similar effects are obtainable in a compressor having operating elements in an outside of a container accommodating compressing elements, which compressor is mainly used for air conditioners for automobile.

Further, in Embodiments 1 through 3, a scroll compressor of a high-pressure shell type, of which space of hermetically sealed vessel 10*d* has an atmosphere of discharge gas or a high pressure of which magnitude is around that of the atmosphere of discharge gas, is exemplified for the description. However, substantially similar functions and effects are obtainable by using a scroll compressor of a low-pressure shell type, of which space of hermetically sealed vessel 10*d* has an atmosphere of suction gas or a low pressure of which magnitude is around that of the atmosphere of suction gas, by installing an oil pump in an end of an main shaft 4, and by supplying a refrigerating oil 10*e* by a pressure of the pump.

The first advantage of a scroll compressor according to the present invention is that a pressure higher than a suction pressure in a space and the same as a discharge pressure or less is not decreased, even though a rotating scroll flaps by a tiny outer disturbance such as variations of a pressure condition for operating and suction of a liquid refrigerant and therefore the rotating scroll is not easily relieved, whereby a highly efficient compressor having high reliability is obtainable.

The second advantage of a scroll compressor according to the present invention is that a rotating scroll is separated from a compliant frame in an axial direction because a space around boss has a higher pressure than a suction pressure; contact force between a thrust surface of the rotating scroll and a thrust bearing of the compliant frame is partially reduced; and a sliding loss of the rotating scroll is reduced and seizure of the thrust bearing caused by an excessive load is avoidable, whereby a highly efficient compressor having high reliability is obtainable.

The third advantage of a scroll compressor according to the present invention is that a rotating scroll is not easily relieved because a pressure in a space is not decreased by preventing a counter flow of fluid in spite of a decrement of an intermediate pressure in a space around boss caused when the rotating scroll flaps by a tiny outer disturbance such as variations in a pressure condition for operation and suction of a liquid refrigerant; and introduction of a pressure into the space becomes easy, whereby a compressor having high reliability at a low cost is obtainable.

The fourth advantage of a scroll compressor according to the present invention is that lubrication to bearings becomes stable because a refrigerating oil in an atmosphere of high pressure stably flows into a space around boss by a predetermined pressure difference determined by a pressure adjusting device or the like under a constant relationship of: pressure in suction area<pressure in space<pressure in space around boss<pressure in discharge area; and therefore a friction coefficient of bearings can be made small and seizure of the bearings is avoidable, whereby a highly efficient compressor having high reliability is obtainable.

The fifth advantage of a scroll compressor according to the present invention is that a working area of a space is not restricted by a working area of a space around boss, namely a degree of freedom in setting the working areas becomes high because a pressure in the space around boss and a pressure in the space are separately set, whereby a compact compressor having high reliability and high efficiency is obtainable.

The sixth advantage of a scroll compressor according to the present invention is that lubrication to bearing becomes stable because a refrigerating oil in a atmosphere of high pressure in a discharge area stably flows into a space around boss by a predetermined pressure difference determined by a pressure adjusting device under a constant relationship of: pressure in suction area<pressure in space around boss<pressure in discharge area; and therefore a friction coefficient of bearings becomes small and seizure of the bearings is avoidable, whereby a highly efficient compressor having high reliability is obtainable.

The seventh advantage of a scroll compressor according to the present invention is that a starting-up property is excellent because normal operation is attained by a rise of a pressure in a space, which pressure is a major factor for lifting up a compliant frame on a side of fixed scroll just after starting up in response to an increment of a pressure in a compression chamber to thereby making the compliant frame float within a relatively short period, whereby a highly efficient compressor having high reliability is obtainable.

The eighth advantage of a scroll compressor according to the present invention is that destruction of scroll turbines and so on caused by an abnormal pressure rise in a compression chamber and seizure of bearings and a main bearing caused by an application of an excessive load are avoidable because a compliant frame is relieved in an axial direction by a relatively large distance before an inner pressure of a compression chamber is abnormally increased; and a starting-up property is excellent by preventing a time for realizing normal operation from extremely lapsing as a result of so-called arbitrary operation without compressing operation when a compliant frame is maximally relieved in an axial direction, namely a rotating scroll is maximally apart from a fixed scroll, at a time of starting because the maximum amount of moving in the axial direction is 300 $\mu$m or less, whereby a highly efficient compressor having high reliability is obtainable.

Obviously, numerous modifications and variations of the present invention are possible in light of the above teachings. It is therefore to be understood that within the scope of the appended claims, the invention may be practiced otherwise than as specifically described herein.

What is claimed is:

1. A scroll compressor comprising:

a fixed scroll having a spiral turbine and a rotating scroll having a spiral turbine, which spiral turbines are engaged each other to form a compression chamber between these, which fixed scroll and rotating scroll are located in a hermetically sealed vessel, a compliant frame for supporting said rotating scroll in its axial direction and supporting a main shaft for driving said rotating scroll in directions of its radiuses, and a guide frame for supporting said compliant frame in the directions of the radiuses, which guide frame is fixed to said hermetically sealed vessel, in which said rotating scroll is movable in the axial direction by a sliding motion of said compliant frame with respect to said guide frame in the axial direction, wherein a space is formed between said compliant frame and said guide frame; and a pressure in the space is higher than a suction pressure and is the same as a discharge pressure or less.

2. A scroll compressor according to claim 1, wherein a space around boss having a pressure higher than the suction pressure and the same as the discharge pressure or less is formed between said rotating scroll and said compliant frame.

3. A scroll compressor according to claim 2, wherein said space around boss and said space are connected; and a fluid is allowed to flow from said space around boss to said space.

4. A scroll compressor according to claim 3, wherein a bottom portion of said hermetically sealed vessel accumulating a refrigerating oil has a high pressure of which magnitude is around that of the discharge pressure;

said space around boss is located in a middle of an oil supplying route and said space is connected to an area having a low pressure through a pressure adjusting device.

5. A scroll compressor according to claim 2, wherein a pressure in said space and a pressure in said space around boss are independent each other.

6. A scroll compressor according to claim 2, wherein a bottom portion of said hermetically sealed vessel accumulating a refrigerating oil has a high pressure of which magnitude is around that of the discharge pressure;

said space around boss is located in a middle of an oil supplying route and said space around boss is connected to an area having a low pressure through a pressure adjusting device.

7. A scroll compressor according to claim 1, wherein said space is connected to said compression chamber under compressing operation to make a pressure in said space higher than the suction pressure and the same as the discharge pressure or less.

8. A scroll compressor according to claim 2, wherein said space is connected to said compression chamber under compressing operation to make a pressure in said space higher than the suction pressure and the same as the discharge pressure or less.

9. A scroll compressor according to claim 5, wherein said space is connected to said compression chamber under compressing operation to make a pressure in said space higher than the suction pressure and the same as the discharge pressure or less.

10. A scroll compressor according to claim 6, wherein said space is connected to said compression chamber under compressing operation to make a pressure in said space higher than the suction pressure and the same as the discharge pressure or less.

11. A scroll compressor comprising:

a fixed scroll having a spiral turbine and a rotating scroll having a spiral turbine, which spiral turbines are engaged each other to form a compression chamber between these, which fixed scroll and rotating scroll are located in a hermetically sealed vessel, a compliant frame for supporting said rotating scroll in its axial direction and supporting a main shaft for driving said rotating scroll in directions of its radiuses, and a guide frame for supporting said compliant frame in the directions of radiuses, which guide frame is fixed to said hermetically sealed vessel, in which said rotating scroll is movable in the axial direction by a sliding motion of said compliant frame with respect to said guide frame in the axial direction, wherein a space is formed between said compliant frame and said guide frame;

a pressure in said space is higher than a suction pressure and is the same as a discharge pressure or less;

and the maximum movable distance of said rotating scroll with respect to said guide frame in the axial direction is 30 $\mu$m or more and 300 $\mu$m or less.

12. A scroll compressor according to claim 11, wherein a space around boss having a pressure higher than the suction pressure and the same as the discharge pressure or less is formed between said rotating scroll and said compliant frame.

13. A scroll compressor according to claim 12, wherein said space around boss and said space are connected; and a fluid is allowed to flow from said space around boss to said space.

14. A scroll compressor according to claim 13, wherein a bottom portion of said hermetically sealed vessel accumulating a refrigerating oil has a high pressure of which magnitude is around that of the discharge pressure;

said space around boss is located in a middle of an oil supplying route and said space is connected to an area having a low pressure through a pressure adjusting device.

15. A scroll compressor according to claim 12, wherein a pressure in said space and a pressure in said space around boss are independent each other.

16. A scroll compressor according to claim 12, wherein a bottom portion of said hermetically sealed vessel accumulating a refrigerating oil has a high pressure of which magnitude is around that of the discharge pressure;

said space around boss is located in a middle of an oil supplying route and said space around boss is connected to an area having a low pressure through a pressure adjusting device.

17. A scroll compressor according to claim 11, wherein said space is connected to said compression chamber under compressing operation to make a pressure in said space higher than the suction pressure and the same as the discharge pressure or less.

18. A scroll compressor according to claim 12, wherein said space is connected to said compression chamber under compressing operation to make a pressure in said space higher than the suction pressure and the same as the discharge pressure or less.

19. A scroll compressor according to claim 15, wherein said space is connected to said compression chamber under compressing operation to make a pressure in said space higher than the suction pressure and the same as the discharge pressure or less.

20. A scroll compressor according to claim 16, wherein said space is connected to said compression chamber under compressing operation to make a pressure in said space higher than the suction pressure and the same as the discharge pressure or less.

* * * * *

UNITED STATES PATENT AND TRADEMARK OFFICE

CERTIFICATE OF CORRECTION

PATENT NO. : 6,135,739
DATED : October 24, 2000
INVENTOR(S) : Hiroshi Ogawa, et al.

It is certified that error appears in the above-identified patent and that said Letters Patent is hereby corrected as shown below:

Title page,
Item [30] the 1st Foreign Application Priority application should be deleted. Item [30] should reads as follows:

--[30] Foreign Application Priority Data
Nov. 20, 1998 [JP] Japan ..... 10-330775--

Signed and Sealed this

Third Day of July, 2001

*Attest:*

Nicholas P. Godici

*Attesting Officer*

NICHOLAS P. GODICI
*Acting Director of the United States Patent and Trademark Office*